United States Patent [19]

Brentini

[11] 4,129,021

[45] Dec. 12, 1978

[54] CLOSURE DEVICE

[76] Inventor: Attilio Brentini, "Le Château", Crissier, Vaud, Switzerland, CH-1023

[21] Appl. No.: 802,805

[22] Filed: Jun. 2, 1977

[30] Foreign Application Priority Data

Aug. 30, 1976 [CH] Switzerland ..... 10948/76

[51] Int. Cl.[2] ..... A44B 15/00

[52] U.S. Cl. ..... 70/456 R; 70/459

[58] Field of Search ..... 70/459, 456 R; 24/3 K, 24/230 R, 230 AK, 230 AL, 230 AM, 230 AN, 251

[56] References Cited

U.S. PATENT DOCUMENTS

| | | | |
|---|---|---|---|
| 1,626,987 | 5/1927 | Venegas | 70/459 |
| 3,635,058 | 1/1972 | Polk | 70/459 |
| 3,776,009 | 12/1973 | MacGlashan | 70/459 |
| 4,037,443 | 7/1977 | Motzer | 70/459 |

*Primary Examiner*—Robert L. Wolfe

*Attorney, Agent, or Firm*—Emory L. Groff, Jr.

[57] ABSTRACT

A key-holder comprising a body having an arcuate passage for an open ring of circular shape. A movable part located in said passage is subjected to a resilient action to be engaged in the open portion of the ring to lock the latter. The body is flat and its main plane substantially coincides with the main plane of the ring.

6 Claims, 5 Drawing Figures

FIG. 1
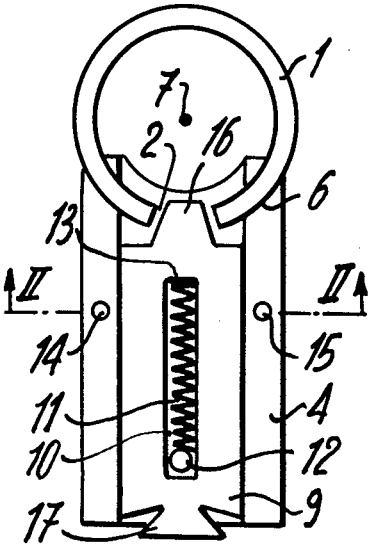
FIG. 4
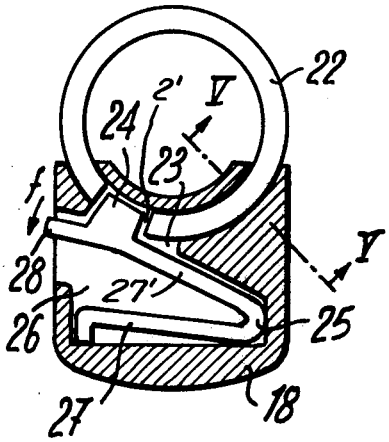
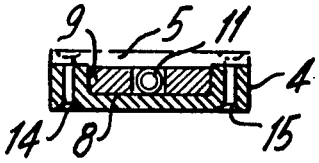
FIG. 2
FIG. 5
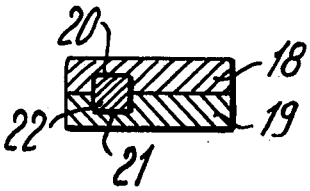
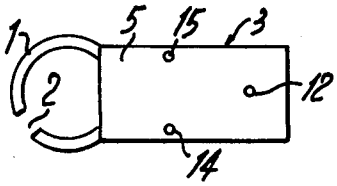
FIG. 3

CLOSURE DEVICE

Closure devices comprising a ring are known which incorporate a body affording passage to an open ring of generally circular shape, this body having a movable part subjected to a resilient action and intended to be engaged in the open portion of the ring to lock the latter. These devices are generally used as key-holders, but other uses are of course possible, and in particular such devices can be used for attaching the end of a chain to some other object.

The present invention is concerned with a device of the above-mentioned kind and its object is to provide a device which is more rigid than the known devices, is of better appearance and operates more easily.

To this end, the closure device in accordance with the invention is characterized in that the body is formed in two parts which are fitted to each other and are of such shape as to form between them an arcuate passage for guiding the ring while permitting it to turn about its own axis of rotation.

Two embodiments of the closure device of this invention will now be described with reference to the accompanying drawing in which:

FIG. 1 is a view of the first embodiment, in which part of the body is omitted so as to disclose the interior mechanism;

FIG. 2 is a section on the line II—II of FIG. 1;

FIG. 3 is a front view;

FIG. 4 is a view of the second embodiment, part of the body being omitted so as to disclose the interior mechanism; and FIG. 5 is a section on the line V—V of FIG. 4.

The illustrated device is a key-holder. As shown in FIGS. 1 to 3 it comprises a circular ring 1 having an opening 2 which, as shown in FIG. 3, can be moved to a position which permits keys to be fitted on and removed from the ring 1.

This ring 1 is held in a body 3 formed by two parts 4 and 5. As shown in FIG. 1, part 4 of the body has an arcuate passage or channel 6 providing a means for guiding the ring 1. The presence of this channel 6 enables the ring 1 to be turned about its axis of rotation 7.

The part 4 also has a seat 8 in which a locking element 9 is slidably fitted. This locking element has a longitudinal recess 10 in which is fitted a helical spring 11. One end of this spring bears against a projection 12 on part 4 of the body 3, and its other end bears against an end face 13 of the recess 10.

The projection 12 is formed by a rivet. This rivet and two other rivets 14 and 15 enable the parts 4 and 5 to be secured to each other and to retain between them the locking element 9 and the ring 1.

As shown in FIG. 1, the locking element 9 has a nose 16 which, under the action of the spring 11, is urged into the opening 2 in the ring 1 to lock the latter against rotation. The element 9 also has a dependent portion 17 of dovetail shape which permits the user to grip this portion 17 between his fingernails to withdraw the element 9 and to free the ring 1. The latter can then be turned to bring it into position illustrated in FIG. 3 for the purpose of fitting keys to the key-holder or removing them thereform.

FIGS. 4 and 5 illustrate the second embodiment. Here the body of the device is formed of two parts 18 and 19 which are fitted to each other, for example, by bonding over the hatched surface shown in FIG. 4. As shown in FIG. 5, each of these parts has a channel 20 and 21 which are disposed opposite each other to form an arcuate passage acting as a guide for a ring 22. These channels 20 and 21 each have a lateral opening 23 affording passage to a displaceable locking element 24 adapted to be biased into engagement within the opening in the open ring 22.

The locking element 24 is formed by a lateral projection on a retainer part 25 made of biasing means or resilient material, for example a synthetic resin, which is substantially V-shaped and is disposed within the cavity or seat 26 formed between the two parts 18 and 19 of the body. This retainer part 25 has two limbs; one relatively fixed limb 27 is entirely enclosed in the seat 26, whereas the other shiftable limb 27' has a free actuating end 28 which projects slightly from the seat 26 so that it can be actuated from the exterior of the body. It can be seen that by moving the end 28 in the direction indicated by the arrow f, the retainer part 25 is elastically deformed and the locking element projection 24 is caused to move out of the open portion 2' of the ring 22. The latter is then unlocked and it can be turned to bring its open portion to the exterior of the body so as to enable the keys to be fitted on or removed from the ring. Thereafter, the ring is turned against until its open portion is located opposite the projection 24 which then resumes the position indicated in the drawing so as to lock the ring 22 against rotation.

The ring 22 is of square or rectangular cross-section and is made of metal, whereas the two parts 18 and 19 are of moulded synthetic resin. Thus the ring 22 can slide very smoothly in the arcuate passage even when, for the purpose of obtaining a very good guiding action, the clearance between the ring and the passage is slight.

It is of course possible to introduce numerous modifications into the device described, and in particular the locking element could be so shaped as to penetrate only partially into the open portion 2 of the ring, so as to form a resilient blocking lug. In the first embodiment, the locking element could also be provided with an opening designed to extend the arcuate channel 6, this element then being urged into a position in which said opening does not coincide with the arcuate channel, so that the ring 1 is blocked against rotation.

The same construction principle can be used for providing means for attaching the end of a chain to some other object, and in this case the locking element may be provided with a key-operated lock and/or a combination lock.

It will be obvious that the closure device described can be put to other purposes. It may be used, in particular, as a removable labelling means, replacing for example tie-on labels.

It should be mentioned that in both embodiments of the device, the ends of the arcuate passage are separated by an arc greater than 120°. To ensure that the ring is guided efficiently in the arcuate channel, it is necessary for the latter to be of a certain length, and it is advantageous that this length should correspond to an arc of at least 90°.

I claim:

1. A closure device including, a ring having an opening, a two-part body provided with a seat and including an arcuate passage therewithin, said passage containing a portion of said ring to permit rotary displacement of said ring about its own axis of rotation, a generally V-shaped retainer part of resilient material disposed within said body, one limb of said retainer part disposed within said seat, the other limb of said retainer part including a laterally projecting locking element biased toward said ring and locking said ring against arcuate displacement when disposed within said ring opening, and said other limb including a free actuating end operable exteriorly of said body whereby, manipulation of said free actuating end causes displacement of said locking element from within said ring opening.

2. A device according to claim 1, wherein said arcuate passage comprises a channel formed on one of the parts of the said body and includes a lateral opening affording passage to said locking element.

3. A device according to claim 1, wherein one of said parts of the body contains said seat within which said retainer part is disposed.

4. A device according to claim 1, wherein each of the two parts of said body includes a channel forming together said arcuate passsge and each of the two parts of said body additionally includes a portion of said seat.

5. A device according to claim 1, wherein the ring has a cross-section of generally square or rectangular shape.

6. A device according to claim 1, wherein the ends of the arcuate passage are separated from each other by an arc of at least 90°.

* * * * *

REEXAMINATION CERTIFICATE (89th)

United States Patent [19]

Brentini

[11] B1 4,129,021

[45] Certificate Issued May 31, 1983

[54] CLOSURE DEVICE

[76] Inventor: Attilio Brentini, "Le Château", Crissier, Vaud, Switzerland, CH-1023

Reexamination Request

No. 90/000,035, Jul. 27, 1981

Reexamination Certificate for:

| | |
|---|---|
| Patent No.: | **4,129,021** |
| Issued: | **Dec. 12, 1978** |
| Appl. No.: | **802,805** |
| Filed: | **Jun. 2, 1977** |

[30] Foreign Application Priority Data

Aug. 30, 1976 [CH] Switzerland ..... 10948/76

[51] Int. Cl.[3] ..... A44B 15/00

[52] U.S. Cl. ..... 70/456 R; 70/459

[58] Field of Search ..... 70/456, 457, 458; 70/459; 24/3K, 230 R, 230 AK; 24/230 AL, 230 AM 230 AN, 251

[56] References Cited

U.S. PATENT DOCUMENTS

| | | | |
|---|---|---|---|
| 1,490,453 | 4/1924 | Caldwell | 70/459 |
| 1,626,987 | 5/1927 | Venegas | 70/459 |
| 2,224,073 | 12/1940 | Augerstein | 70/459 |
| 3,635,058 | 1/1972 | Polk | 70/459 |
| 3,776,009 | 12/1973 | MacGlashan | 70/459 |
| 4,037,443 | 7/1977 | Motzer | 70/459 |

FOREIGN PATIENT DOCUMENTS

| | | |
|---|---|---|
| 465258 | 2/1914 | France. |
| 1215876 | 11/1959 | France. |

*Primary Examiner*—Robert L. Wolfe

[57] ABSTRACT

A key-holder comprising a body having an arcuate passage for an open ring of circular shape. A movable part located in said passage is subjected to a resilient action to be engaged in the open portion of the ring to lock the latter. The body is flat and its main plane substantially coincides with the main plane of the ring.

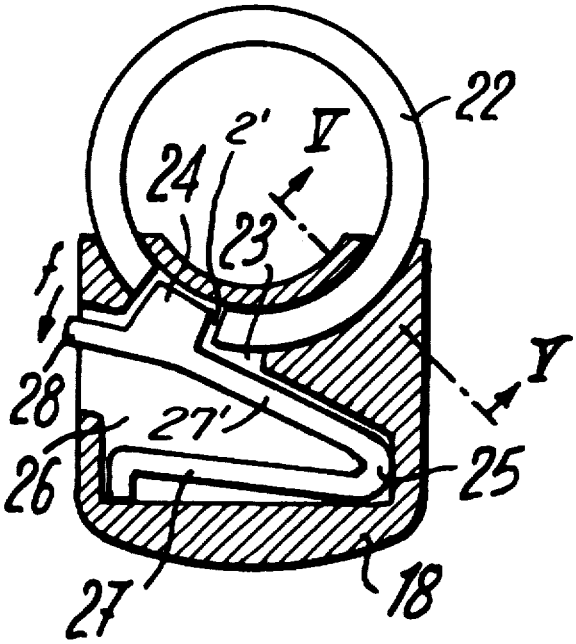

REEXAMINATION CERTIFICATE ISSUED UNDER 35 U.S.C. 307.

THE PATENT IS HEREBY AMENDED AS INDICATED BELOW.

Matter enclosed in heavy brackets appeared in the patent, but has been deleted and is no longer a part of the patent; matter printed in italics indicates additions made to the patent.

AS A RESULT OF REEXAMINATION, IT HAS BEEN DETERMINED THAT:

Claims 1–4, having been finally determined to be unpatentable, are cancelled.

Claims 5 and 6, are determined to be patentable as amended:

5. A device according to claim [1] *7*, wherein the ring has a cross-section of generally square or rectangular shape.

6. A device according to claim [1] *7*, wherein the ends of the arcuate passage are separated from each other by an arc of at least 90°.

New claim 7 is added and determined to be patentable.

*7. A closure device including a two-part body defining an arcuate passage extending therethrough and opening through the upper portion of said body, said body having an internal cavity therein below said arcuate passage, said body including a side opening communicating with said cavity, said arcuate passage provided with a lateral opening extending downwardly and communicating with said cavity, a ring having a portion of its body disposed within said arcuate passage and a substantial portion of its body projecting upwardly from said body to permit rotary displacement of said ring about its own axis of rotation, said ring having an opening, a retainer part of resilient material disposed within said cavity and pressing against one wall of said cavity, said retainer part being generally V-shaped and having two limbs joined by a connecting portion, one said limb pressing against one said cavity wall and the other said limb including a laterally projecting locking element biased into said arcuate passage lateral opening and locking said ring when urged into said ring opening, a free actuating end on said other limb disposed through said body side opening and operable exteriorly of said body, said locking element disposed on said other limb between said free actuating end and said connecting portion, and said arcuate passage, internal cavity, lateral opening and side opening formed in juxtaposed sandwiched portions of said parts of said body whereby, manipulation of said free actuating end causes displacement of said locking element from within said ring opening.*

* * * * *